US007424993B2

(12) United States Patent
Bell

(10) Patent No.: US 7,424,993 B2
(45) **Date of Patent: *Sep. 16, 2008**

(54) COMBINATION SPRING TENSION ROD AND MOUNTING BRACKETS FOR WINDOW COVERINGS

(75) Inventor: Ronald T. Bell, Jamestown, NC (US)

(73) Assignee: Newell Window Furnishings, Inc., Freeport, IL (US)

( * ) Notice: Subject to any disclaimer, the term of this patent is extended or adjusted under 35 U.S.C. 154(b) by 3 days.

This patent is subject to a terminal disclaimer.

(21) Appl. No.: 11/612,303

(22) Filed: Dec. 18, 2006

(65) Prior Publication Data

US 2007/0090245 A1 Apr. 26, 2007

Related U.S. Application Data

(63) Continuation of application No. 10/612,220, filed on Jul. 2, 2003, now Pat. No. 7,287,734.

(60) Provisional application No. 60/393,321, filed on Jul. 2, 2002.

(51) Int. Cl.
*A47H 15/00* (2006.01)

(52) U.S. Cl. ..... 248/262; 248/267; 211/105.1

(58) Field of Classification Search ..... 160/33, 160/319; 248/261–265, 268, 269, 257; 211/105.6, 211/105.5, 123, 160, 105.2
See application file for complete search history.

(56) References Cited

U.S. PATENT DOCUMENTS 519,840 A 5/1894 Edsall
833,557 A 10/1906 Snyder
872,689 A * 12/1907 Sarkisian ..... 211/105.2
1,721,306 A 7/1929 Koering (Continued)

FOREIGN PATENT DOCUMENTS

EP 0 421 913 A 4/1991

(Continued)

OTHER PUBLICATIONS

PCT International Search Report issued in PCT/US03/20884, dated Oct. 9, 2003.

(Continued)

*Primary Examiner*—Gwendolyn Baxter
(74) *Attorney, Agent, or Firm*—Marshall, Gerstein & Borun LLP

(57) ABSTRACT

A combination spring tension rod and mounting bracket assembly easily mounts within a window opening. The spring tension rod includes a pair of elbow-shaped receptacles including a first and second arm defining an angle greater than 90°, wherein each first arm is mounted on opposite ends of the rod and the second arm defines a receptacle for a respective mounting bracket. Each of a pair of mounting bracket devices is mounted into the respective receptacle. The spring tension rod is compressed and positioned such that bearing surface portions of the bracket devices extend into the window opening. The spring tension rod is then released and forces the obtusely-oriented bearing surfaces to bear against opposed and facing surfaces of the window opening when installed. The spring force of the spring tension rod retains the rod and brackets in the installed position.

20 Claims, 3 Drawing Sheets

U.S. PATENT DOCUMENTS

| | | | |
|---|---|---|---|
| 2,079,267 | A | 5/1937 | Vroom et al. |
| 2,199,851 | A | 5/1940 | Culver |
| 2,474,434 | A | 6/1949 | Mentz |
| 2,647,644 | A | 8/1953 | Cieslik |
| 2,973,870 | A | 3/1961 | Schoos |
| 3,506,135 | A | 4/1970 | Klingaman |
| 3,570,412 | A | 3/1971 | Holman, Jr. |
| 4,147,199 | A | 4/1979 | Cameron |
| 4,488,651 | A | 12/1984 | Bishop |
| 4,744,471 | A | 5/1988 | Leister |
| 5,011,030 | A | 4/1991 | Alaurent |
| 5,143,336 | A | 9/1992 | McMichael |
| 5,242,065 | A | 9/1993 | Hoban |
| 5,810,302 | A | 9/1998 | McCance |
| 6,598,843 | B1 | 7/2003 | Bell et al. |

FOREIGN PATENT DOCUMENTS

| | | | |
|---|---|---|---|
| EP | 0 962 175 | A | 12/1999 |
| FR | 1 337 034 | A | 9/1963 |

OTHER PUBLICATIONS

PCT International Written Opinion issued in PCT/US03/20884, dated Mar. 23, 2004.

* cited by examiner

COMBINATION SPRING TENSION ROD AND MOUNTING BRACKETS FOR WINDOW COVERINGS

RELATED APPLICATION DATA

This application a continuation of pending U.S. patent application Ser. No. 10/612,220, which was filed on Jul. 2, 2003, that is related to U.S. Provisional Application Ser. No. 60/393,321, which was filed on Jul. 2, 2002.

FIELD OF THE INVENTION

The present invention generally relates to window covering mounting hardware, and more particularly to a combination spring tension rod and mounting bracket system for hanging window coverings.

BACKGROUND OF THE INVENTION

There are many types of hardware for hanging various forms of window coverings. Certain types of window coverings, such as curtains, hang from a curtain rod that is suspended horizontally traversing a width of a window opening. There are also many configurations of curtain rods and mounting brackets systems to hang curtains. The rod and bracket mounting hardware also can vary from elaborate and expensive to very simple and inexpensive.

An example of an elaborate rod and bracket assembly is one screwed or otherwise affixed to a wall above the window opening and adapted to accommodate curtains with pull cords or draw strings that are used to open and close the curtains. An example of a very simple construction is a spring tension rod that is compressed, set within a window opening, and released. The ends of the rod forcibly bear against opposite sides of the opening and use function to retain the rod in position. The rod supports a curtain with a plurality of loops or an elongate tunnel through which the rod is threaded.

Problems with the mole elaborate systems are for example, relatively high cost installation complexity, and suitability for hanging simple window curtains. Such elaborate systems are not always desirable or warranted as a simple solution for covering a window opening.

Problems with simple spring tension curtain rod are, for example, that they do not always stay suspended within the window opening, can support only so much weight, and are not capable of supporting a curtain outside or spaced outward from the window opening. Each spring tension rod has a design limit as to how much weight it can vertically support before the suspended load overcomes the friction force supporting the rod. Also, the spring mechanism of the rod can become less resilient over time or as a result of repeated use, causing the applied friction force to reduce. Further, a typical spring tension rod requires that it be positioned within the window opening between opposed surfaces and thus, a curtain can only be suspended within the opening. As a result, such a rod cannot be used to hang curtains positioned forward from the window opening. Such an aesthetic look is often desirable.

There are other intermediate types of curtain hanging systems where the rod is positioned similar to the more elaborate system described above. However, the mounting hardware can be difficult to install. Numerous fasteners are needed to attach mounting brackets to a wall surface. The rod is then suspended from the brackets. To install such a rod can require taking measurements, drilling holes, utilizing anchors for drywall or plaster surfaces, and installing fasteners.

BRIEF DESCRIPTION OF THE DRAWINGS

Objects, features, and advantages of the present invention will become apparent upon reading the following description in conjunction with the drawing figures, in which.

DETAILED DESCRIPTION OF THE PREFERRED EMBODIMENTS

A combination spring tension rod and mounting bracket assembly is disclosed and described herein. The assembly solves or improves upon the above-noted problems in the prior art. The disclosed combination spring tension rod and mounting bracket assembly has a pair of mounting bracket devices for use with a spring tension rod wherein the bracket devices mount within a window opening and support the spring tension rod spaced outward from the window opening. Portions of the bracket devices bear against the window opening and portions connect with the ends of the rod. Tension in the rod forces the bracket devices against the window opening surfaces to retain the rod in the suspended position.

Figures 1, 11, 13:
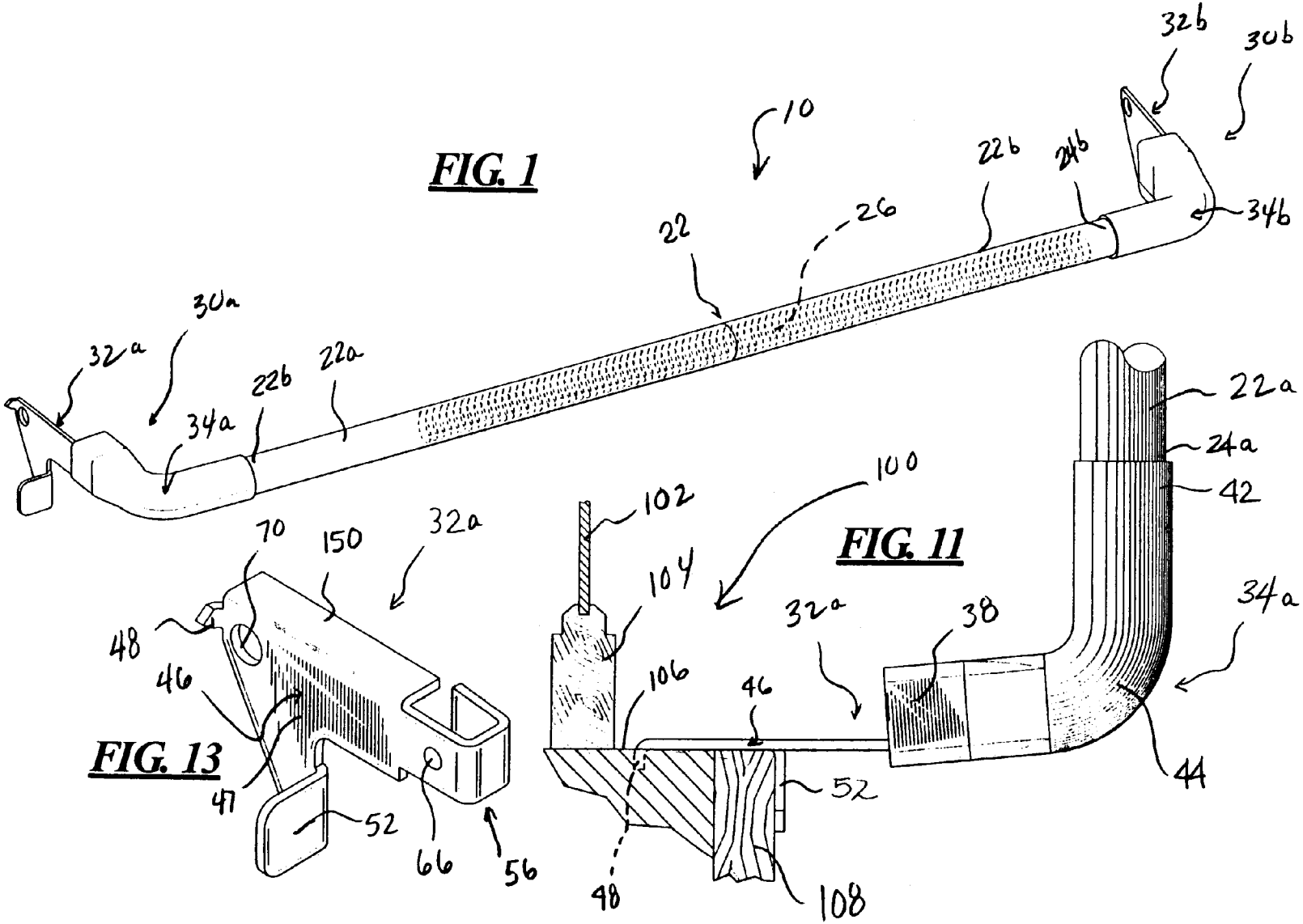
FIG. 1 is a perspective view of one example of a combination spring tension rod and mounting bracket assembly constructed in accordance with the teachings of the present disclosure.
FIG. 11 is a top view of the left end of the assembly as installed in a window opening.
FIG. 13 is a perspective view of another example of a mounting section for the bracket device shown in FIGS. 4-6.
Figure 4:
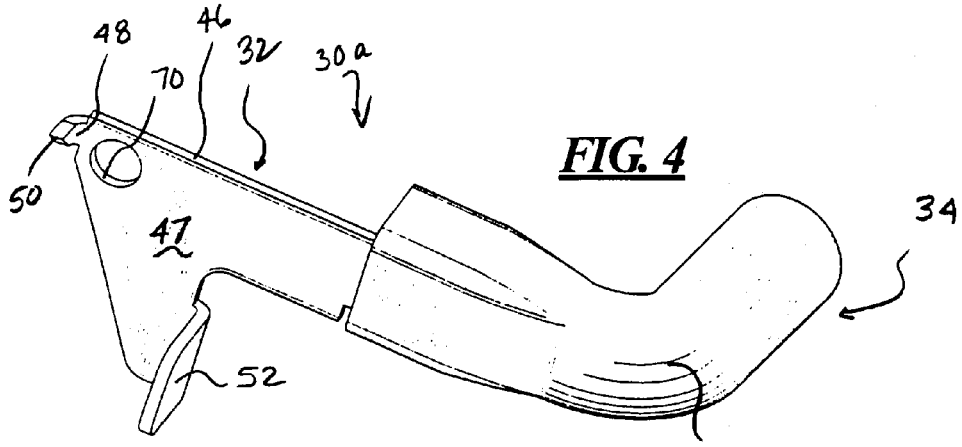
FIG. 4 is a perspective view of the assembled mounting bracket device far the left end of the assembly shown in FIG. 2.
Figure 2:
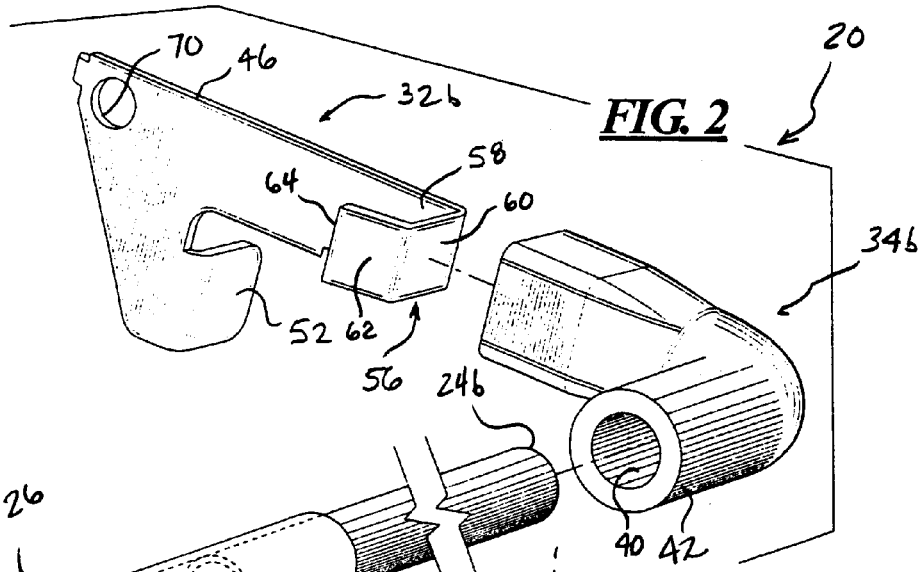
FIG. 2 is an enlarged exploded view of the right end of the assembly shown in FIG. 1.

Turning now to the drawings, FIGS. 1 and 2 illustrate a combination spring tension rod and mounting bracket assembly 20 constructed in accordance with the teachings of the present disclosure. The assembly 20 generally has a spring tension rod 22 constructed of two telescoping rod sections 22*a* and 22*b* in a conventional manner known to those having ordinary skill in the art. Each rod section 22*a* and 22*b* defines one of two opposed rod ends 24*a* and 24*b*. A spring 26 is captured within the rod sections 22*a* and 22*b* of the rod 22. The length of the rod 22 can be changed to a desired length in a conventional manner. Any desired rod length can be selected as long as it is between the minimum and maximum length for a particular rod. Once adjusted to the selected length, the rod ends 24*a* and 24*b* can be compressed toward one another by overcoming the biasing force of the spring 26. When released, the rod 22 returns to the selected length. Rod compression and release is performed for installation and removal. The assembled rod defines a concentric longitudinal rod axis over its length in this example.

In this example, the assembly 20 also has a pair of mounting bracket devices 30*a* and 30*b*, one each removably attached to the ends 24 of the rod 22. As shown in FIGS. 1-4, the two bracket devices 30*a* and 30*b* in this example are formed as left side and right side, or mirror image devices. However, the devices 30*a* and 30*b* are otherwise substantially identical in configuration and construction. Therefore, only one of the bracket devices, the left side device 30*a*, is described in detail herein and is identified herein after as bracket device 30. The description for device 30 herein is thus equally applicable to both devices 30*a* and 30*b*. Similarly, the rod and rod ends are hereinafter identified as the rod 22 (no reference to the specific rod sections 22*a* or 22*b*) and the rod ends 24 (no reference to the specific ends 24*a* or 24*b*).

The disclosed mounting bracket device 30 has a mounting section 32 and an elbow section 34. The mounting section 32 is generally configured to attach or bear against a side surface of a window opening as is described below with reference to FIG. 11. The elbow section 34 is generally configured to couple with the mounting section 32 at one end and with an end 24 of the rod 22 at its opposite end.

With reference to FIGS. 2-6, one example of the elbow section 34 is disclosed. In this example, the elbow section 34 has a female receptacle 36 formed at a first end or bracket attachment end 38. The receptacle 36 has a generally rectangular or square configuration in the disclosed example. The elbow section 34 also has a rod interface for connection to an end of the spring tension rod. In this example, interface is a rod insertion opening 40 that is formed at all opposite second end or rod attachment end 42. The insertion opening 40 is constructed and arranged to receive or insert an end 24 of the rod 22. The opening 40 in this example has an axis that corresponds with the rod axis when installed in the opening. Its shape corresponds to that of the rod end 24.

An elbow region 44 interconnects the two ends 38 and 42. In this example, the elbow region 44 is constructed with the two ends 38 and 42 arranged at a slightly obtuse angle $\beta$ relative to one another. In this example, the angle $\beta$ is about 95°. In other examples, the angle $\beta$ can be greater or less than the disclosed 95° obtuse angle, such as a 90° or right angle. The purpose of the slightly obtuse orientation angle $\beta$ in this example is described below.

The disclosed elbow section 34 can be fabricated from virtually any suitable material. However, in this example, the elbow section 34 is molded from a suitable thermoplastic material. Though not shown in this example, the elbow section 34 can be fabricated with one or more strengthening ribs, ridges, or the like to stiffen the part so that it does not flex or bend beyond a permissible range, if at all.

Figure 5:
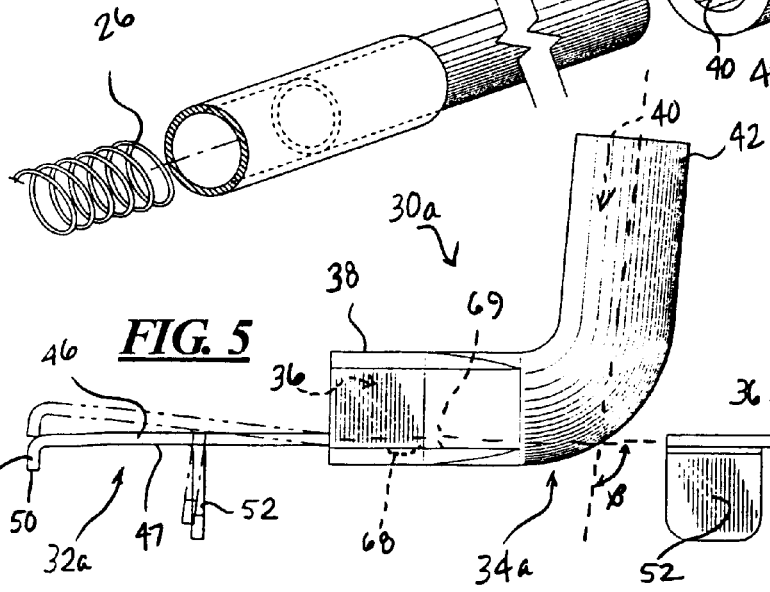
FIG. 5 is a top view of the assembled bracket device shown in FIG. 3
Figure 6:
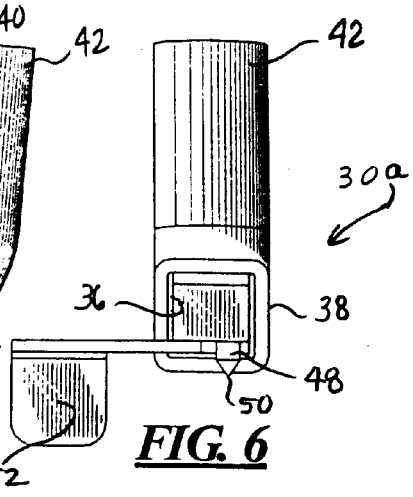
FIG. 6 is a rear end view of the assembled bracket device shown in FIG. 3
Figure 3:
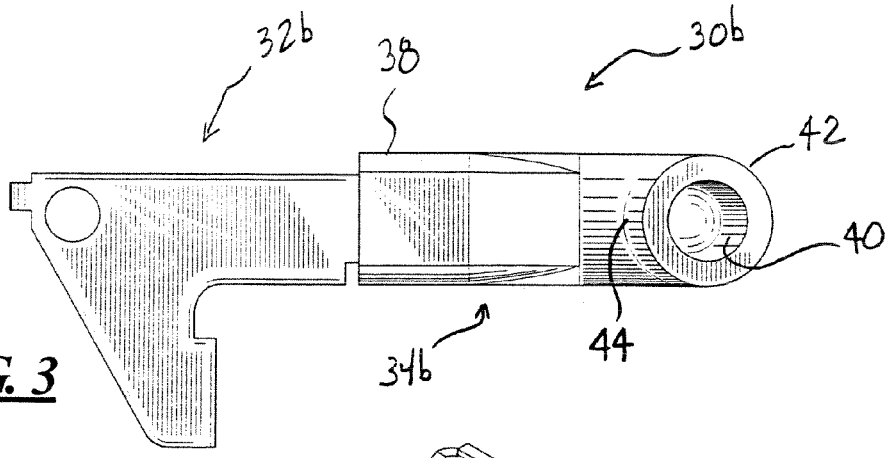
FIG. 3 is a left side view of the bracket device shown in FIG. 2.
Figure 8:
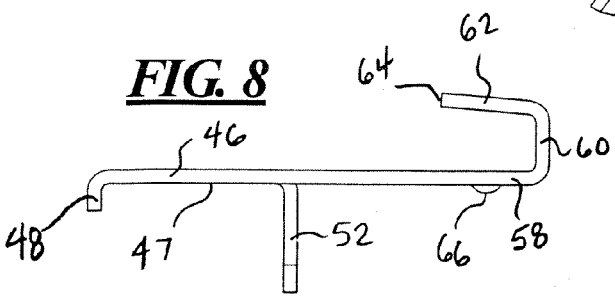
FIG. 8 is a top view of the mounting section shown in FIG. 7.
Figure 7:
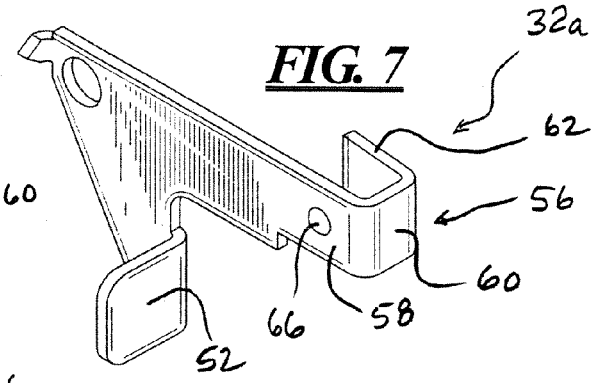
FIG. 7 is a perspective view of the mounting section of the bracket device shown in FIG. 4.
Figure 9:
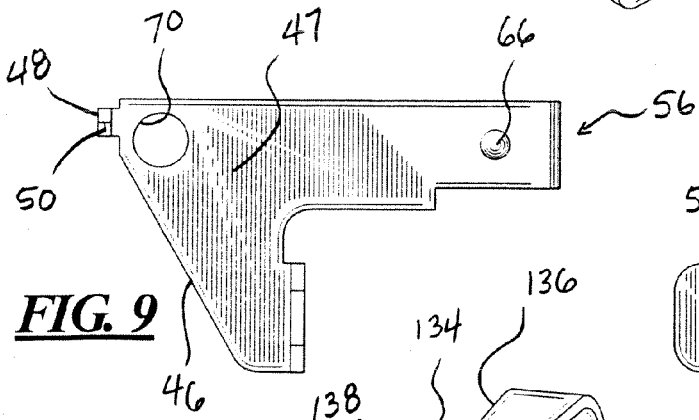
FIG. 9 is a left side view of the mounting section shown in FIG. 7.
Figure 10:
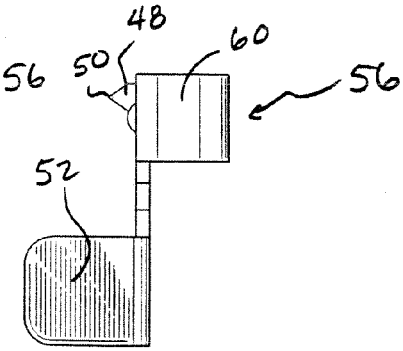
FIG. 10 is a front end view of the mounting section shown in FIG. 7.

Turning to FIGS. 7-10, the disclosed mounting section 32 has a generally flat portion 46 defining an outward facing (opposite direction relative to the orientation of the bracket device at the other end of the rod) bearing surface 47 on one side. The bearing surface 47 is oriented and configured to bear against a side surface of a window opening. In this example, the pair of bearing surfaces 47*a* and 47*b* of the two brackets define mounting planes that are slightly angled or tilted outward away from one another after being attached to the rod, but before being installed in a window opening, as shown in FIGS. 1 and 5. However, in this example, the bearing surfaces are not twisted relative to one another or to the rod axis so that when installed, the bearing surfaces are parallel.

A prong or tang 48 projects generally perpendicularly outward from a part of the flat portion 46 near a rear end of the bearing surface 47. The prong 48 can have a sharp point 50 at its distal end. The sharp point 50 will assist in digging into or embedding in a surface of a window opening when installed.

An anti-rotation tab 52 also projects generally perpendicularly outward relative to a part of the mounting section 32 near a forward edge of the bearing surface 47. The anti-rotation tab 52 has a length sufficient to extend onto and bear against a front surface adjacent a window opening. The tab 42 also has a width sufficient to provide adequate anti-rotation function as described below. In this example, the tab is positioned beneath a plane defined by the rod interface or opening 40 and the prong or tang 48. With no additional fastener being used, the bracket will pivot downward about the tang position. By placing the tab 52 below this reference plane, it acts as an anti-rotation device.

The size, shape, and contour of the tabs 52 can vary according to the needs of a particular project. Some forward facing surfaces surrounding window openings are not smooth or perpendicular to the window opening, but are instead rounded or curved and/or at non-right angles to the opening. The tabs can be configured and sized to properly function and accommodate such different surfaces characteristics.

In this example, an attaching mechanism extends forward from and generally parallel to the flat portion 46 and is adapted to be inserted in the receptacle 36 of the elbow section. The disclosed attaching mechanism is a U-shaped male insert 56 with a first leg 58 formed as a part of the flat portion 46. The male insert 56 also has a second leg 60 arranged generally perpendicular to the first leg. A third leg 62 extends from the second leg and is arranged confronting and spaced from the first leg. In this example, the third leg 62 terminates at a distal free end 64 and is angled relative to the first leg with the free end spaced further from the first leg 58 than the end connected with the second leg.

A raised bump 66 is formed centrally in the first leg 58 and projects in an outward direction exterior to the U-shaped insert 56. Also in this example, a recess 68 is provided in the interior of the female receptacle 36 and positioned on an outward wall surface 69 within the receptacle. The recess 68 corresponds in location to the bump 66 when the mounting section 32 and elbow section 34 are attached.

In one example, the mounting section 32 is formed from a steel material, such as spring steel. The mounting section 32 can be die cut from sheet steel and stamped or otherwise bent to form. The section 32 can then be heat treated or otherwise further treated is necessary to provide the desired resilient material characteristics. However, the material used to fabricate the mounting section 32 can vary considerably and yet fall within the scope of the present invention. For example, the mounting section 32 can be molded from resilient, relatively flexible plastic or thermoplastic materials if desired. Also, one or more strengthening ribs or ridges can be formed in the mounting section 32 to increase its strength and to prevent bending in unintended regions of the mounting section after installation.

Turning again to FIGS. 2-6, to assemble the bracket devices 30, the attachment mechanism, in this case the male insert 56, is inserted into the female receptacle 36. The mounting section 32 and elbow section 34 are oriented when attached so that the elbow region 44 is directed inward with the rod attachment end 38 facing in a direction opposite to the bearing surface 47, the prong 48, and the tab 52. The raised bump 66 engages the recess 68 when the male insert 56 is fully inserted. The slightly outward angled third leg 62 of the insert 56 will be forced toward the first leg 58 as the insert 56 is pushed into the receptacle. The resiliency of the material of the mounting section 32, the angle of the third leg 62, and the size of the receptacle 36 combine such that, in this example, the first and third legs of the insert 56 are biased against the walls of the receptacle. The biasing force assists in positively holding the bump 66 into the recess 68 to retain the insert 56 of the mounting section 32 within the receptacle 36. Each of the bracket devices 30 is assembled in the same manner.

The bump 66 and recess 68 provide, in one example, a positive detent or "snap-in-place" feature to the bracket device 30. In another example, a ridge (not shown) can be provided within the receptacle 36. The distal end 64 of the third leg 62 can ride over the ridge while the mounting section 32 is installed, and then can snap into place behind the ridge when fully inserted. In a further example, both the ridge and bump detent configurations can be utilized, one on each side of the receptacle 36.

For proper installation, the rod 22 can be adjusted to its desired length, if adjustable, for a particular width of a window opening 12. A curtain or curtain parts (not shown) can be installed over the rod 22. The ends 24 of the rod 22 are then inserted, one each into a corresponding rod insertion opening 40 of the devices 30. (Once the bracket devices 30 are assembled and attached to the rod, they should be rotationally aligned with one another relative to or about the rod axis. The combination spring tension rod and mounting bracket assembly 20 is then ready to install.

Installation of the combination spring tension rod and mounting bracket assembly 20 is described in conjunction with FIGS. 1, 5, and 11. As shown in FIGS. 1 and 5, the flat portions or mounting planes 46 of the mounting sections 32 are flared or tilted slightly outward relative to one another when assembled on the rod 22. This is as a result of the obtuse angle β of the elbow sections 34. In this example, the 95° angle of each elbow section 34 results in the flat portions being angled 5° outward from a perpendicular reference relative to the rod 22 orientation. This angle can vary. The surfaces 46 can be perpendicular or can be angled at angles greater than 5°, if desired, and depending upon a given project and/or upon the flexibility of the bracket components.

As shown in FIG. 5, the general U-shape of the male insert 56 positions the flat portion 46 of the mounting section 32 adjacent the outward wall 69 of the receptacle 36. The size and shape of the receptacle opening 36 permits the flat section 46 to flex or bend inward (shown in phantom in FIG. 5) toward the rod attachment end 42 of the elbow section 34 to an orientation normal or perpendicular to the rod. The resiliency of the mounting section material permits this to occur.

As shown in FIG. 11, a conventional or typical window opening 100 has a glass window 102 covering a majority of the opening. A window frame structure 104 supports the glass within the opening 100. The window opening 100 typically has opposed sill and top surfaces (not shown) and a pair of opposed side surfaces 106. The side surfaces 106 generally face one another and are parallel to one another. Often, outward facing trim structures 108 extend around and frame the opening 100.

To install the assembly 20, the rod 22 can be compressed slightly to permit each of the mounting sections 32 of the devices 30 to fit between the side surfaces 106 in the window opening 100. The devices 30 are inserted within the opening 100 to a depth where the anti-rotation tabs 52 bear against the forward facing surface, in this example the trim structure 108, of the opening 100. The compressed rod 22 can then be released. Upon release, the rod ends 24 push the elbow sections 34 outward away from one another. The prongs 48 bear against and dig into the side surfaces 106 of the opening 100. As the rod ends 24 push further outward, the flat portions 46 bend inward (see FIG. 5) until the bearing surfaces 47 are flush against the side surfaces 106 (see FIG. 11).

The resiliency of the material of the mounting section 32, the angle of the third leg 62, the angle β of the elbow section 34, and the spring characteristics of the rod spring 26 can be designed and selected to insure that the rod does not excessively bend the mounting sections 32 beyond the orientation shown in FIG. 11.

One or more fastener openings 70 can provided in each flat portion 46, if desired, between the anti-rotation tab 52 and the prong 48 in this example. The flat portion 46 can be configured to provide such openings at any desired position, not necessarily just between the prong and tab. Once installed, a fastener can be installed through each of the openings 70 to further stabilize the installed combination 20, such as where the curtains are within reach of children. However, the combination 20 is intended to function properly under many circumstances without the need for such additional fasteners. The fastener openings can also be used in place of the tangs or prongs 48, if desired. The tab position should then be such that is beneath a plane defined by the rod interface and the openings 70 to function properly.

Figure 12:
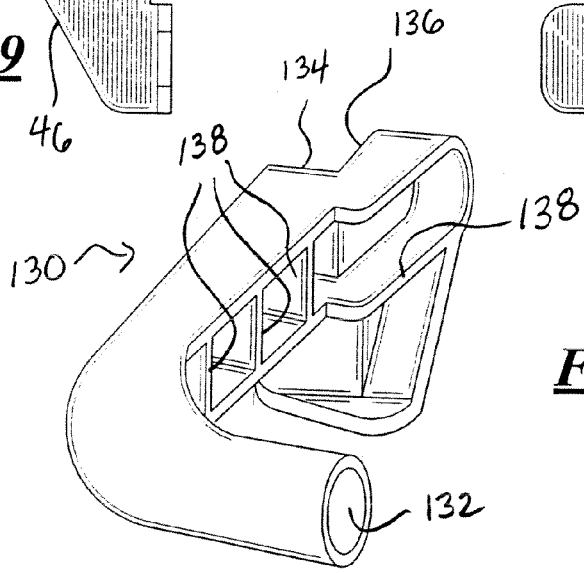
FIG. 12 is a perspective view of another example of a one-piece molded plastic bracket device for the assembly shown in FIG. 1.

FIGS. 12 and 13 illustrate just two of many different examples of mounting bracket device alternatives which fall within the scope and spirit of the disclosure. FIG. 12 illustrates a one-piece plastic molded bracket device 130 wherein the previously described mounting section and elbow section have been combined. In this example, the bracket device 130 has a rod attachment opening 132 at one end. The device 130 also has an anti-rotation surface 134 and a bearing surface 136 for mounting the bracket to a window opening surface. The device also has optional strengthening ribs 138 formed therein to stiffen the part. In this example, an elbow region 140 has a 90° and the bracket is not intended to bend once installed. The device 130 can have other features similar to the prongs 48 and fastener openings 70 described above, if desired.

FIG. 13 illustrates an alternative mounting section 32 constructed in substantially that same configuration as that shown in FIGS. 7-10. In this example, the section 32 has a bent flange portion 150 extending from a top edge of the flat portion 46. The flange portion 150 can be provided herein to prevent the flat portion 46 from bending, except in the region adjacent the male insert 56, similar to the above-described (but not shown) strengthening ribs or ridges. The flange portion 150 is oriented in this example at a right angle relative to the flat portion 46. As a further alternative, the elbow sections 34 can be provided defining right angles between the ends 38 and 42. The mounting section 32 can then be provided with enhancements, such as the flange portion 150, to prevent the section from bending at all when installed.

Although particular examples of window covering rod and bracket assemblies have been disclosed and described herein in accordance with the teachings of the present invention, the scope of coverage of this patent is not limited thereto. On the contrary, this patent covers all embodiments of the teachings of the invention that fairly fall within the scope of permissible equivalents.

What is claimed is:

1. A bracket assembly for use with a spring tension rod for hanging window coverings, the bracket assembly comprising:

a mounting section defining a bearing surface facing in a first direction; and a rod interface coupled to the mounting section and facing in a second direction generally opposite the first direction, the rod interface adapted to connect with one end of the spring tension rod, wherein the rod interface is arranged relative to the bearing surface to position the rod interface spaced away from a window opening in a direction generally perpendicular to the first and second directions when the bearing surface is borne against a surface of the window opening, and an elbow section coupled to the mounting section and defining the rod interface, the elbow section having a first arm and a second arm, wherein the first arm and the second arm define an angle greater than 90°.

2. A bracket assembly according to claim 1, further comprising:

an elbow section coupled to the mounting section and defining the rod interface;

wherein the mounting section and the elbow section are separate parts; and wherein the mounting section has a male attachment mechanism received in a female receptacle end of the elbow section.

3. A bracket assembly according to claim 2, wherein a snap detent feature is provided between the attachment mechanism and the receptacle end.

4. A bracket assembly according to claim 1, wherein the mounting section further comprises:

an anti-rotation tab extending outwardly in the first direction relative to the bearing surface and generally perpendicular to the bearing surface, the tab positioned to prevent downward rotation of the spring tension rod when installed; and a sharp pointed tang extending outwardly in the first direction relative to the bearing surface and generally perpendicular to the bearing surface.

5. The bracket assembly of claim 1, wherein the first leg and the third leg are outwardly biased relatively to each other.

6. The bracket assembly of claim 1, the mounting section including a flat section that comprises the bearing section and the first leg.

7. A hardware assembly for mounting window coverings, the hardware assembly comprising:

a spring tension rod having a pair of opposite rod ends and a longitudinal rod axis, each of the opposite rod ends including an elbow section defining an angle of greater than 90° relative to the longitudinal rod axis; and a pair of mounting brackets, one mounting bracket coupled to a female receptacle end of each elbow section, each of the mounting brackets including;

a rod interface connected to the female receptacle end of the elbow section; and a bearing surface coupled to the rod interface and extending radially outward relative to the rod axis, wherein the mounting brackets connect to the rod interface; and wherein the bearing surfaces of the respective mounting brackets face generally outwardly opposite one another and in line with the respective female receptacle end of the elbow section to resiliently bend toward one another to bear against opposed surfaces of a window opening when installed.

8. A hardware assembly according to claim 7, wherein the opposed surfaces of the window opening are not parallel.

9. A hardware assembly according to claim 7, wherein the spring tension rod is length adjustable.

10. A hardware assembly according to claim 7, wherein each bearing surface is provided on a corresponding mounting section of each mounting bracket.

11. A hardware assembly according to claim 10, wherein the elbow section and mounting section of each mounting bracket are discrete parts assembled to one another.

12. A hardware assembly according to claim 10, wherein the mounting section of each mounting bracket includes a male attaching mechanism received in a female receptacle of the respective elbow section.

13. A hardware assembly according to claim 10, wherein the elbow section and the mounting section of each mounting bracket in combination include a snap-in detent when assembled.

14. A hardware assembly according to claim 7, further comprising:

at least one anti-rotation tab positioned adjacent the bearing surface of each mounting bracket, each anti-rotation tab extending generally perpendicular to and in the facing direction of its respective bearing surface.

15. A hardware assembly according to claim 7, further comprising:

a sharp pointed embedding tang positioned adjacent the bearing surface of each mounting bracket, each sharp pointed embedding tang extending generally perpendicular to and in the facing direction of its respective bearing surface.

16. A hardware assembly according to claim 7, further comprising:

a fastener opening provided through a portion of the bearing surfaces of each of the mounting brackets for receiving a fastener when installing each mounting bracket.

17. A method of mounting a spring tension rod for hanging window coverings over a window opening, the method comprising the steps of:

providing a spring tension rod having a rod axis and opposed ends biased away from one another and compressible toward one another;

attaching a pair of mounting brackets, one to each of the opposed ends of the spring tension rod, each of the mounting brackets having a mounting section connected to an elbow section, each elbow section defining an angle of greater than 90°, a rod interface on the elbow section connected to a respective one of the opposite ends of the spring tension rod, a bearing surface on the mounting section and extending radially outward relative to the rod axis, and a sharp pointed tang extending from adjacent each of the bearing surfaces and generally perpendicular to the respective bearing surface;

rotationally aligning the pair of mounting brackets with one another about the rod axis;

fitting the spring tension rod to the window opening by compressing the spring tension rod opposed ends and mounting brackets toward one another;

placing the bearing surfaces adjacent corresponding opposed and facing surfaces of the window opening with the spring tension rod spaced outward from the window opening; and releasing the spring tension rod such that the bearing surfaces are borne against the opposed and facing surfaces of the window opening.

18. A method according to claim 17, wherein the step of attaching further includes forming an anti-rotation tab extending from each of the hearing surfaces and generally perpendicular to the respective bearing surface, and wherein the step of placing further includes positioning each of the anti-rotation tabs borne against a forward facing surface adjacent the window opening.

19. A method according to claim 17, wherein the step of attaching further includes forming an anti-rotation tab extending from adjacent each of the bearing surfaces and generally perpendicular to the respective bearing surface, and wherein the step of placing further includes positioning each of the anti-rotations tabs borne against a forward facing surface adjacent the window opening.

20. A method according to claim 19, wherein the step of attaching further includes forming a sharp pointed tang extending from adjacent each of the bearing surfaces and generally perpendicular to the respective bearing surface, and wherein the step of releasing causes each tab to embed in one of the opposed and facing surfaces of the window opening.

* * * * *

UNITED STATES PATENT AND TRADEMARK OFFICE

CERTIFICATE OF CORRECTION

PATENT NO. : 7,424,993 B2
APPLICATION NO. : 11/612303
DATED : September 16, 2008
INVENTOR(S) : Ronald T. Bell It is certified that error appears in the above-identified patent and that said Letters Patent is hereby corrected as shown below:

At Column 8, line 58, “hearing” should be -- bearing --.

Signed and Sealed this

Twentieth Day of January, 2009

JON W. DUDAS
*Director of the United States Patent and Trademark Office*